United States Patent [19]

Duff

[11] 4,438,708

[45] Mar. 27, 1984

[54] COMPLETE INCINERATION OF WASTE MATERIAL

[75] Inventor: Russell E. Duff, Solana Beach, Calif.

[73] Assignee: S-Cubed, LaJolla, Calif.

[21] Appl. No.: 407,787

[22] Filed: Aug. 13, 1982

[51] Int. Cl.[3] ..... F23G 9/00

[52] U.S. Cl. ..... 110/346; 110/239

[58] Field of Search ..... 110/239, 235, 237, 346

[56] References Cited

U.S. PATENT DOCUMENTS

| | | | |
|---|---|---|---|
| 1,141,747 | 6/1915 | Zysset | 110/239 |
| 3,195,608 | 7/1965 | Voorheis et al. | 431/5 |
| 3,658,015 | 4/1972 | Griffin et al. | 110/7 R |
| 3,797,412 | 3/1974 | DiPaola et al. | 109/29 |
| 4,077,337 | 3/1978 | Demoiseau | 110/235 |
| 4,279,208 | 7/1981 | Guillaume et al. | 110/346 |
| 4,387,655 | 6/1983 | Chaiken | 110/347 |

*Primary Examiner*—Henry C. Yuen

*Attorney, Agent, or Firm*—Fitch, Even, Tabin & Flannery

[57] ABSTRACT

Waste materials are deposited in a subsurface cavity, either underground or underwater. The wastes are supplied with liquid oxygen in an amount in excess of the estimated theoretical amount of oxygen needed to oxidize all components of the waste. An ignition source is provided. During incineration, the organic components are completely destroyed, water and carbon dioxide being the major combustion products. At the temperatures that develop, substantially all of the metal is converted to metallic oxides, which either remain in an underground cavity or sink harmlessly to the bottom of a body of water.

13 Claims, 3 Drawing Figures

30
31
44
32
2.
20
27
22
42
21
2.
33

26

25
30'
22
20
PCB
SUL-
FUR
PCB
40
24'
21
40
24
LOX
SUPPLY
20
26'
50
52
40

COMPLETE INCINERATION OF WASTE MATERIAL

The present invention relates to waste disposal and more particularly to waste incineration methods.

BACKGROUND OF THE INVENTION

The problems of disposing of the large amounts of various wastes generated by technological societies need not be elaborated on in great detail herein. They range from the relatively simple problem of lack of space for waste disposal, resulting from the depletion of existing landfill sites, to the more serious problems of disposing of highly toxic organic wastes.

In the past, incineration has provided an inexpensive method of disposing of many types of wates; however, due to perceived environmental problems, laws may exist that either prohibit incineration or require that expensive capital investment be made in air scrubbing equipment or the like to provide environmentally acceptable emissions. The need continues for more effective waste disposal methods, particularly for disposing of the most hazardous of toxid organic wastes.

SUMMARY OF THE INVENTION

A subsurface cavity, either underground or underwater, is provided in which wastes, such as organic substances, toxic materials, explosives and including their containers, are deposited, and the cavity is supplied with liquid oxygen in excess of that required to completely burn and oxidize both organic and metallic components of waste materials and their containers. Substantially all of the metallic components of the waste are converted by liquid oxygen incineration to metallic oxides, which in the case of incineration in an underground cavity remain therein, and in the case of underwater incineration, sink to the bottom of the body of water. The organic components are completely destroyed, water and carbon dioxide being the major combustion products. The water is either absorbed in the ground or becomes part of the body of water, while the carbon dioxide either reacts with minerals in the soil or body of water or escapes to the atmosphere. Minor combustion products generally react with minerals in the water or in the ground to form stable, generally harmless compounds.

DETAILED DESCRIPTION OF THE PREFERRED EMBODIMENTS

Figures 1, 2, 3:
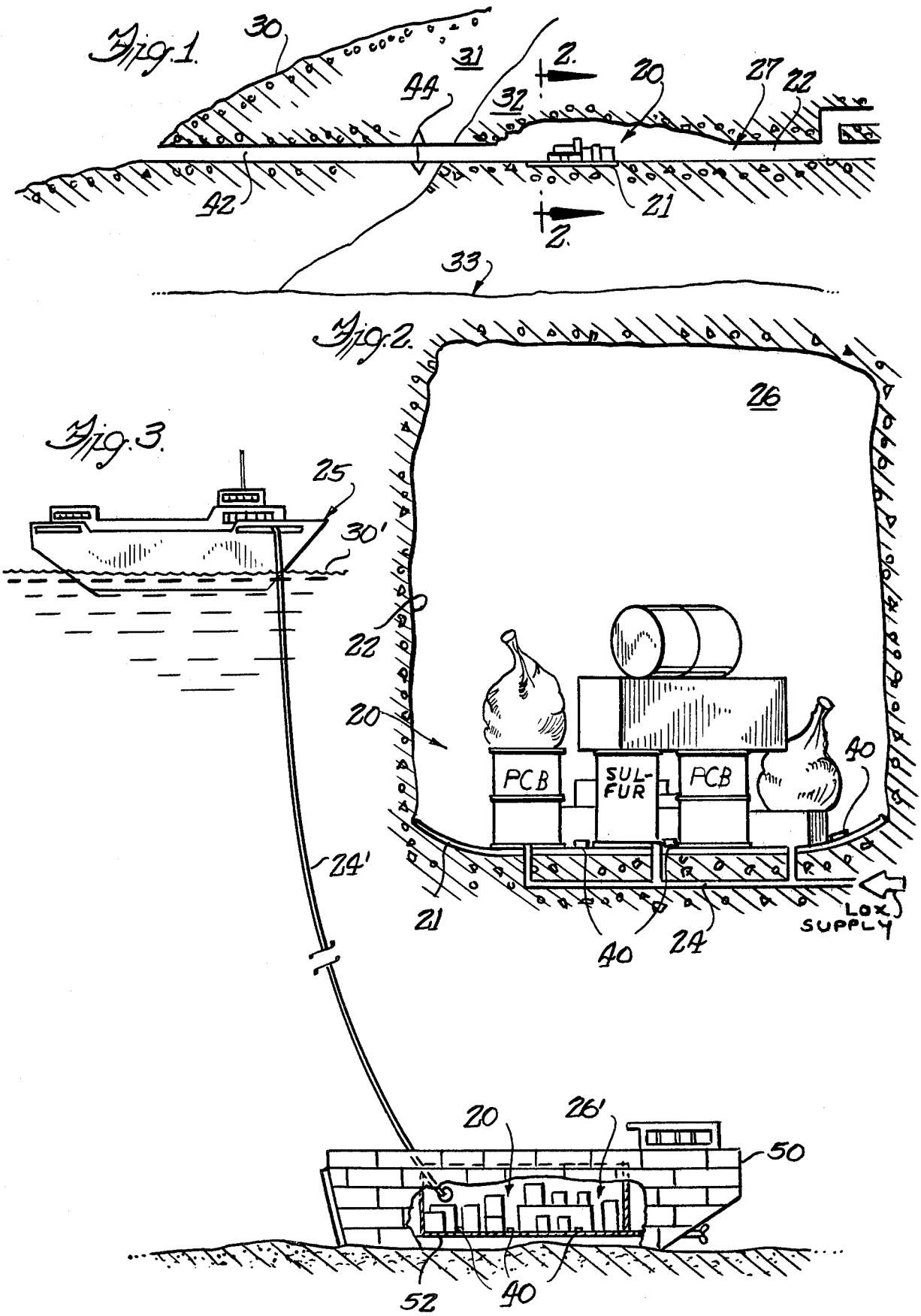
FIG. 1 is a cross-sectional view of a tunnel dug horizontally into the side of a mountain to a suitable stratigraphic horizon and containing a region in which wastes are deposited and incinerated.
FIG. 2 is a cross-sectional view taken along line 2—2 of FIG. 1.
FIG. 3 is a diagrammitic illustration of an underwater incineration procedure using a submerged barge to provide a cavity in which wastes are deposited and to which liquid oxygen is supplied.

In accordance with the present invention, wastes 20 (FIGS. 1 and 2) are deposited at a combustion site 26 in a subsurface cavity 22, either underground or underwater, and incinerated in the presence of an excess of liquid oxygen, whereby all of the organic components and substantially all of the metallic components are incinerated at very high temperatures. Because by its nature this invention involves incineration in which wastes and their containers are consumed, there is no need to moderate combustion temperatures so as to limit erosion or oxidation of furnace parts as in conventional incineration processes. The rate of combustion is governed by the rate at which liquid oxygen is supplied. The organic components are converted primarily to water and carbon dioxide which pass harmlessly to the surrounding ground or body of water, while the metals are converted to metallic oxides, which either remain in an underground chamber or sink to the bottom of a body of water.

Incineration in an underground cavity 22 represents the preferred embodiment of the invention. Illustrated in FIG. 1 is such an underground cavity 22 in the form of an elongated horizontal tunnel complex formed in the side of a mountain. A substantially vertical shaft to a suitable geological strata would also provide a useful site for incineration. The tunnel 22 is formed in a geological structure 31 capable of withstanding, with a minimum of support, the pressures which are generated by the combustion process, as it is highly preferred that the cavity may be used for repeated incinerations. The depth of the combustion site 26 below the surface 30 is not considered to be particularly critical, providing that the depth is sufficient for good containment of combustion products. Whenever possible, an existing cavity, such as a cave or an abandoned mine complex, is desired because providing a new tunnel represents a substantial capital expenditure; however, in the case of very hazardous wastes, such expenditures may be economically justifiable.

The cavity 22 is preferably provided above the water table 33 in a geological strata 32 having high gas porosity and permeability to allow the inflow of gaseous combustion products. Permeabilities of about 1 darcy or above are preferred because the size of the cavity that must be provided for incinerating a given amount of wastes in a given time depends on the amount of vapor which can quickly diffuse into the walls of the cavity. The applicability of this invention, however, does not require a geologic formation with any particular value of permeability. The incineration rate must be matched to the combustion products acceptance rate of the entire facility. This depends on formation permeability, porosity, and the surface area available. Examples of suitable geological structures include well cemented sandstone, alluvium or volcanic tuff.

The amount of oxygen supplied for incineration is in excess of that which is theoretically required for complete oxidation of the wastes, and at least twice this amount is generally provided to assure complete combustion. If the exact composition of the waste is known, the liquid oxygen requirement may be precisely calculated. This, of course, may not generally be the case, but if a rough estimation of the metallic and organic components can be made, the oxygen requirement can be estimated by considering the organic component to be pure hydrocarbon $(CH_2)_2$ that is burned completely to carbon dioxide and water and considering the metallic components to be pure iron that is completely oxidized to $Fe_2O_3$. It is important to supply a large excess of oxygen so that everything present will be completely oxidized.

As one means of exposing the wastes 20 to an excess of oxygen, a relatively impermeable base surface 21 (FIG. 2) is provided at the underground combustions site 26 within the cavity 22. The waste materials 20, including organic and inorganic chemicals in metal containers 19, are deposited on the surface 21. Liquid oxygen is supplied to the site 26 by a pipeline 24 leading from the exterior of the cavity 22 to the impermeable surface 21.

As a means of inititating incineration, at least one charge 40, such as thermite charge, is placed at an outer edge of the site 26 in order that combustion proceeds from the outer edge of the site inward. Preferably, a plurality of such charges 40 are disposed amount the waste packages in the combustion site 26 and simultaneously ignited in order to assure more generally uniform burning. Herein, a plurality of charges 40 are placed on the impermeable surface 21 at the lower edge of the combustion site 26, and when the charge 40 is ignited, combustion proceeds generally from the bottom upward.

After the site 26 has been filled with waste containers 20, the entrance 42 (FIG. 1) to the cavity 22 is closed, such as by a strong, thermally insulated door 44 which can be reopened. The flow of liquid oxygen through the pipeline 24 to the combustion site 26 is begun, the liquid oxygen initially vaporizing to create an oxygen-rich atmosphere at the site of combustion within the cavity 22 and then accumulating in liquid form on the impermeable surface 21. After sufficient liquid oxygen has been supplied to the combustion site 26, the charges 40 are ignited by remote means, e.g., by electrical ignition. Liquid oxygen is continued to be pumped through the pipeline 24 to the site 26 until an amount is provided sufficient to effect complete combustion of all of the waste materials, organic and inorganic, and their containers. Combustion proceeds at a rate determined by the rate of oxygen supply, and high temperatures are developed—in the range of 2000°-3000° K. At these temperatures, all of the wastes, including the metallic components, are completely oxidized.

For some classes of toxic waste, absolute assurance of complete chemical destruction must be provided. This can be enhanced by providing a liquid oxygen spray through injection ports 27 (FIG. 1) at a location within the tunnel complex 22, remote from the combustion site 26, into which the combustion products will flow. Any high temperature combustible material which might escape the combustion site would be burned in the oxygen rich domain near the supplemental oxygen injection ports 27.

Water vapor produced by the combustion of organic components diffues into the porous geological material where it condenses and eventually moves to the water table 33 below the cavity 22 or to the surface by capillary forces. Carbon dioxide also diffuses into the porous material and either reacts with minerals in the ground or eventually escapes to the atmosphere. The oxidized metals, and perhaps trace amounts of noble metals, remain on the base surface 21 of the combustion site 26 where they may be recovered if the commercial value of the metal oxides and possible noble metals would indicate the desirability of recovery.

The following calculation illustrates the feasibility of underground disposal according to the method of the invention. Assuming the following conditions: combustion occurring at a pressure of 25 bars and a temperature of 3000° K, tunnel permeability of 1 darcy, and 50 mole percent steam and 50 mole percent carbon dioxide product gases; more than 1 kg of product gases can diffuse into a square meter of tunnel wall per minute for more than 20 minutes. After 20 minutes, the acceptance rate still exceeds 0.5 kg/m$^2$ min. Under these conditions, one thousand tons of waste can be packed into 110 meters of a 3 m×3 m tunnel. If burned at a rate of 10 tons per minute, 40,000 square meters of diffusion area is needed. Such area is provided by about 3.2 km of a 3 m×3 m tunnel. The energy released is equivalent to about 2000 tons of explosives. Typically, smaller amounts of waste will be burned at slower rates and correspondingly smaller facilities are required.

Illustrated in FIG. 3 is an alternative embodiment of the present invention in which a cavity 22′ or void space is provided below the surface 30′ of a body of water using a submerged container 50.

The container 50 is filled with wastes 20 and preferably transported out to sea beyond the continental shelf where any risks to the environment are minimal. There the container 50 is sunk to the bottom. Liquid oxygen is supplied through a conduit 24′ from a surface tanker 25, and the oxygen-supplied waste 20 is ignited using, for instance, thermite charges 40. In this case the oxygen supply can be continuous, as in the tunnel version of this invention, in which case the pressure developed upon combustion can be controlled, or the site 26′ can be filled with an excess of liquid oxygen prior to ignition, in which case higher, uncontrolled pressure will be developed by the more rapid combustion of the wastes 20 and part or all of the container 50.

The great pressures resulting from the development of vapors during rapid combustion provide a void space within the water even after the rupture of the container 50. Water vapor subsequently condenses while the carbon dioxide either reacts with dissolved minerals or escapes to the atmosphere. Metallic oxides and other precipitates sink harmlessly to the ocean floor.

A convenient container 50 for incinerating large amounts of wastes may be provided by using the hull of a retired barge whose scuttling is already contemplated. Some modifications of the barge are required to provide the substantially enclosed site 26′; for example, an inner shell 52 might be fitted within the barge to provide the water-tight combustion site 26′. The tanker 25 carrying the required amounts of liquid oxygen tows the waste-filled barge 50 to the place of incineration where the ocean has a substantial depth. The barge 50 is sunk, sufficient liquid oxygen is pumped into its hold and means are provided for igniting the oxygen-supplied wastes 20. Even larger underwater cavities might be provided using the hull of a retired ship. The total amount of liquid oxygen might also be supplied to the vessel before it is sunk, and the charges set off by a timed or depth-sensitive device.

The combustion products are generally harmless to the environment whether combustion is effected in a subsurface gelogocial site or an underwater site. Metallic oxides are very stable chemically and are generally insoluble in water, and hence, whether deposited in land or water, pose substantially no threat to the environment. Even though some reaction products such as HF, HCl, $H_3PO_4$ may be produced that do not precipitate, they will react with calcuim carbonate in the soil or sea water to form $CaF_2$, $CaCl_2$ or $Ca_3(PO_4)$, which are well known, stable minerals or fertilizers. Oxides of sulfur, predominantly $SO_2$ and $SO_3$, that may be produced would likewise react with carbonates in the soil or sea water to form products like $CaSO_4$, that are environmentally benign. Even if some traces of environmentally undesirable water soluble or gaseous material is produced, it is unlikely that such compounds compare in toxicity to some of the wastes whose destruction is contemplated using the method of the present invention, and any environmental damage would be minimal compared with most other waste disposal methods, such as waste burial.

If the nature of the wastes is such that it would be expected that significant amounts of environmentally deleterious combustion products would be formed, the wastes may be mixed with chemicals that would react with such combustion products during incineration to form stable, environmentally safe compounds. For example, calculations have shown that CaO added to the reaction system will promptly precipitate $CaF_2$, $CaCl_2$, $Ca_3(PO_4)_2$. This approach could be used if insufficient $CaCO_3$ were present in the soil or water.

The method of invention is generally applicable as it completely destroys all wastes, whether metallic or organic. The economic feasibility of practicing the method depends on its cost relative to alternative disposal methods. Considering the cost of producing, transporting storing and handling liquid oxygen, this method may not be the preferred method for disposing of all wastes. However, for hazardous wastes, particularly wastes that are primarily organic substances including highly toxic components, the method provides a relatively economical and completely safe method of disposal.

The advantages of the incineration method of the present invention may now be more readily appreciated. Complete destruction of all classes of hazardous chemical wastes, in particular organic materials, is assured primarily because extremely high temperatures are involved—much higher than in any conventional incinerator. The wastes may be incinerated in their containers thus requiring no unpacking, draining, or separate handling. The method is flexible being capable of handling essentially any amount of material, and various types of waste can be mixed together without danger. A major economy of the method is that no capital facilities of the conventional sort are required.

The method is almost completely noninjurious to the environment. Substantially no atmospheric pollution problems or water pollution problems arise. There is no subsequent disposal problem of secondary wastes from the incineration because no detoxification products are produced.

While the invention has been described in terms of certain preferred embodiments involving organic materials in metallic containers, many other waste forms may be destroyed by this invention, and modifications obvious to one with ordinary skill in the art may be made without departing from the scope of the invention.

Various features of the invention are set forth in the following claims.

What is claimed is:

1. A method of disposing the waste material comprising providing in porous geological strata an unvented underground cavity of a size sufficient to assure that removal of the volatile combustion products of the complete oxidation of the waste material to be deposited therein occurs only by diffusion through the porous gelogical strata, said cavity being at a depth sufficient for good containment of combustion products, depositing the waste material at a combustion site within said cavity, sealing said unvented cavity, supplying liquid oxygen to the waste material at said site in excess of the estimated amount required to completely oxidize both the organic and metallic components of the waste material, and igniting said waste material, whereupon combustion proceeds converting substantially all of the waste material to ash and volatile combustion products, said sealing of said cavity assuring that substantially all of the volatile combustion products will diffuse into the porous geological strata, whereupon the volatile combustion products condense or react with chemicals in the ground so that only relatively harmless volatile products eventually reach the surface.

2. A method according to claim 1 wherein the waste materials are primarily organic substances.

3. A method according to claim 1 wherein the waste materials are organic or inorganic substances in metallic containers.

4. A method according to claim 1 wherein the amount of liquid oxygen that is provided is at least two times the estimated amount required to completely oxidize all components of said waste.

5. A method according to claim 1 wherein said wastes are ignited simultaneously at spaced apart locations about an outer edge of said site, whereby combustion proceeds generally uniformly from said outer edge inward.

6. A method according to claim 1 and recovery of metallic oxides from said cavity.

7. A method according to claim 1 wherein the geological strata that provide walls of said cavity have permeabilities of at least about one darcy.

8. A method according to claim 1 wherein liquid oxygen is supplied to said wastes in sufficient quantitity to burn said wastes at temperatures of about 2000° K or above.

9. A method of disposing of waste material comprising providing in geological strata having permeabilities of at least about one darcy an unvented underground cavity of a size sufficient to assure that removal of the volatile combustion products of the complete oxidation of the waste material to be deposited therein occurs only by diffusion through the geological strata, cavity being at a depth sufficient for good containment of combustion products, providing at a combustion site within said cavity an impermeable, liquid-holding surface, depositing the waste material on said surface, sealing said unvented cavity, supplying liquid oxygen to the waste material on said surface in at least about twice the estimated amount required to completely oxidize both the organic and metallic components of the waste material, and simultaneously igniting said waste material at spaced-apart locations about an outer edge of said site, whereupon combustion proceeds generally uniformly from said outer edge inward converting substantially all of the waste material to ash and volatile combustion products, said cavity sealing assuring that substantially all of the volatile combustion products diffuse into the porous geological strata where they condense or react with chemicals in the ground so that only relatively harmless volatile products eventually reach the surface.

10. A method of disposing of waste material comprising providing a container and depositing the waste material in said container, supplying liquid oxygen to said container in excess of the estimated amount required to completely oxidize the organic and metallic components of the waste material, submerging said container in the ocean so that said wastes and liquid oxygen are contained in an unvented underwater combustion site, and igniting said waste material to create a rapid combustion, whereupon substantially all of the waste material is converted to ash and volatile combustion products, said container ruptures, the ash and ruptured container sink to the ocean floor and the volatile combustion products rise through the seawater, condensing within the seawater or reacting with chemicals in the seawater so that only relatively harmless volatile products reach the ocean surface.

11. A method according to claim 10 wherein the amount of liquid oxygen that is provided is at least two times the estimated amount required to completely oxidize all components of said waste.

12. A method according to claim 10 wherein said wastes are ignited simultaneously at spaced apart locations about an outer edge of said site, whereby combustion proceeds generally uniformly from outer edge inward.

13. A method according to claim 10 wherein liquid oxygen is supplied to said wastes in sufficient quantity to burn said wastes at temperatures of about 2000° K. or above.

* * * * *

UNITED STATES PATENT AND TRADEMARK OFFICE

CERTIFICATE OF CORRECTION

PATENT NO. : 4,438,708

DATED : March 27, 1984

INVENTOR(S) : Russell E. Duff

It is certified that error appears in the above-identified patent and that said Letters Patent is hereby corrected as shown below:

Column 1, line 17, change "wates" to --wastes--.

Column 1, line 24, change "toxid" to --toxic--.

Column 2, line 60, change "$(CH_2)_2$ to --$(CH_2)_n$--.

Column 3, line 7, change "inititating" to --initiating--.

Column 3, line 11, change "amount" to --among--.

Column 4, line 55, change "gelogocial" to --geological--.

Column 5, line 66, change "gelogical" to --geological--.

Column 6, line 38, change "quantitity" to --quantity--.

Column 6, line 49, after "strata," insert --said--.

Column 8, line 13, after "from" insert --said--.

Signed and Sealed this

Second Day of October 1984

[SEAL]

*Attest:*

GERALD J. MOSSINGHOFF

*Attesting Officer*

*Commissioner of Patents and Trademarks*